US006002414A

United States Patent [19]

Kobori et al.

[11] Patent Number: 6,002,414

[45] **Date of Patent: *Dec. 14, 1999**

[54] FIELD EMISSION PRINT HEAD

[75] Inventors: Yoichi Kobori; Yukihiko Shimizu, both of Mobara, Japan

[73] Assignee: Futaba Denshi Kogyo K.K., Mobara, Japan

[ * ] Notice: This patent is subject to a terminal disclaimer.

[21] Appl. No.: 08/672,702

[22] Filed: Jun. 27, 1996

[30] Foreign Application Priority Data

Jun. 28, 1995 [JP] Japan ..... 7-183310
Jun. 28, 1995 [JP] Japan ..... 7-183311
Jun. 28, 1995 [JP] Japan ..... 7-183312

[51] Int. Cl.[6] ..... B41J 2/415

[52] U.S. Cl. ..... 347/123

[58] Field of Search ..... 347/115, 121, 347/122, 127, 128, 237, 238; 313/446, 422, 447, 448, 496; 361/777; 315/167, 169.1; 445/24, 50

[56] References Cited

U.S. PATENT DOCUMENTS 5,606,358 2/1997 Beaman ..... 347/237
5,760,810 6/1998 Onodaka ..... 347/123

FOREIGN PATENT DOCUMENTS 4-43539 2/1992 Japan .

*Primary Examiner*—N. Le
*Assistant Examiner*—L. Anderson
*Attorney, Agent, or Firm*—Oblon, Spivak, McClelland, Maier & Neustadt, P.C.

[57] ABSTRACT

A field emission print head capable of converging electrons and having a structure such that odd order gate lines are connected to a first gate lead electrode, even order gate lines are connected to a second gate lead electrode. When the first gate lead electrode is selected and operated, the potential of the second gate lead electrode is made to be a low level. Since the odd order gate line is disposed between the low level even order gate lines, emitted electrons can be converged. When the second gate lead electrode is selected and operated, also emitted electrons can be converged. Each gate line has field emission cathodes disposed in a zigzag configuration. Since the first gate lead electrode is made to always be a low level as a converting electrode, the field emission print head can easily be manufactured.

10 Claims, 11 Drawing Sheets

FIG.5
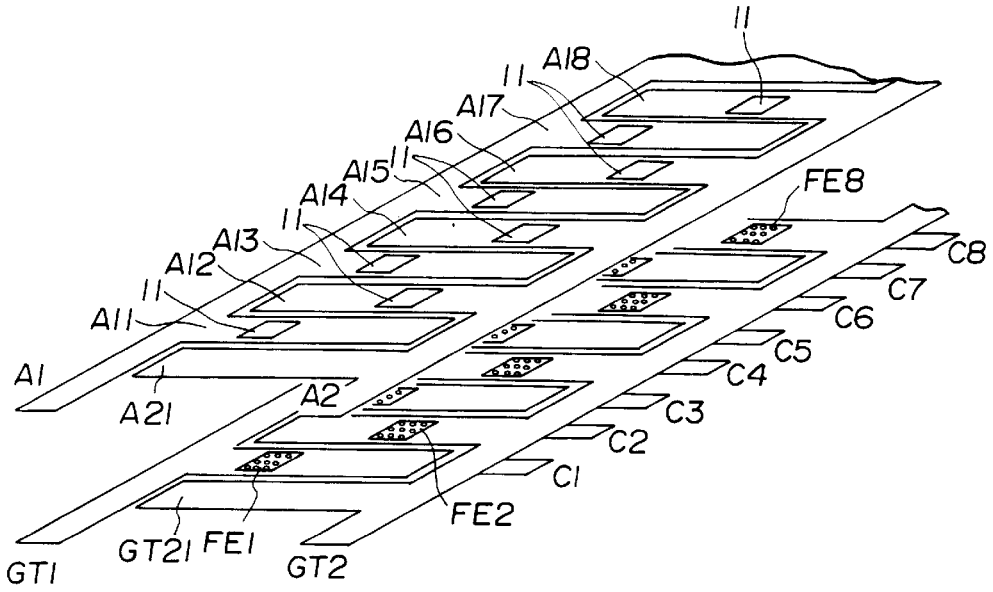
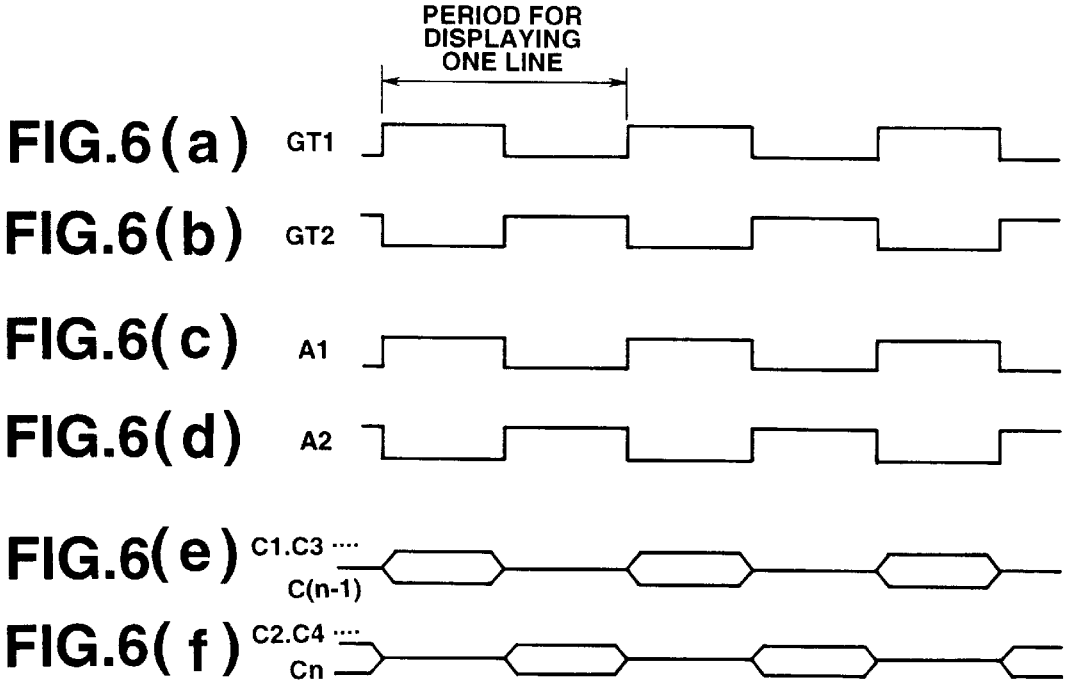

FIELD EMISSION PRINT HEAD

BACKGROUND OF THE INVENTION

1. Field of the Invention

The present invention relates to a print head adaptable to an optical printer, and more particularly to a print head having a field emission device.

2. Related Art

Hitherto, optical printers have been known. The schematic structure of the optical printer will now be described with reference to FIG. 1. A film 120 is coated with a sensitive material, such as silver halide (silver salt), so as to be exposed to light when the lower surface of the film 120 is irradiated with light reflected by a mirror 121.

The film 120 is irradiated with light emitted from a print head 125. The print head 125 is supplied with image data for each line. Light modulated by image data above is main-scanned vertically on the surface of the sheet and the print head 125 is sub-scanned as indicated by an arrow shown in FIG. 1 so that one image is printed on the film 120 by a line sequential method.

Reference numeral SLA 122 represents a SELFOC lens array serving as a lens for causing light emitted from the print head 125 to be focused on the surface of the film 120. A mirror 123 introduces light into the SLA 122.

An RGB filter 124 is an optical filter of three primary colors for printing a color image on the film 120. In a case where a color image is printed, image data for one line is decomposed into R (red), G (green) and B (blue) image data, and then the RGB filter 124 is sequentially moved to correspond to image data for each color so that the RGB filter 124 performs the main scanning operations three times. That is, the main scanning operations performed by three times result in the color image for one line being recorded on the film 120.

An optical printer of the foregoing type has a light source which has been a light emitting diode (LED) or a fluorescent character display tube of a thermionic emission type. In recent years, use of semiconductor microprocessing technique has enabled micron size field emission devices to be formed into an array configuration on a substrate. A field emission print head using the foregoing field emission device array as the electron source has been suggested (refer to Japanese Patent Laid-Open No. 4-43539).

An example of the structure of a conventional field emission print head of the foregoing type is shown in FIGS. 2A, 2B and 2C. FIG. 2A is a schematic plan view, FIG. 2B is a schematic cross sectional view taken along line 2B—2B shown in FIG. 2A, and FIG. 2C is a detailed cross sectional view taken along line 2C—2C shown in FIG. 2A. As shown in FIGS. 2A, 2B and 2C the field emission print head has a first flat substrate 101 having a plurality of field emission devices 105 formed thereon, a second flat substrate 102 disposed opposite to the first flat substrate 101 and having a fluorescent member 106 and so forth formed thereon, a holder member 103 for maintaining a predetermined distance from the first flat substrate 101 to the second flat substrate 102, and a vacuum layer 104 surrounded by the first flat substrate 101, the second flat substrate 102 and the holder member 103.

The first flat substrate 101 is made of an n-type silicon single crystal substrate and covered with a silicon oxide film ($SiO_2$ film) 101' except the field emission devices 105 and the substrate contact electrode 107 thereof. The second flat substrate 102 is made of a transparent glass substrate and having a transparent anode electrode 109 and a fluorescent member 106 laminated on the surface thereof. The field emission devices 105, each having a cathode electrode and a gate electrode, and the fluorescent member 106, having an anode electrode, are disposed to opposite to each other in such a manner that a vacuum layer 104 is formed between the field emission devices 105 and the fluorescent member 106. A pair of the field emission device 105 and the fluorescent member 106 form a unit light source. Each unit light source has one field emission device sectioned by gate electrodes separated from one another and disposed in the form of an array. The cathode electrode of each of the field emission device shares a monocrystal silicon plate. Also the anode electrode is commonly shared.

One field emission device, as shown in FIG. 2C, has a plurality of projecting cathode electrodes (emitters) 111 formed on the surface of the first flat substrate 101 and gate electrodes 112 formed on the $SiO_2$ film 101' and having openings adjacent to the foregoing projections. The gate electrodes 112 are separated from one another by each field emission device.

Although the first flat substrate 101 is made of the single crystal silicon substrate and the projections are formed by anisotropic etching of the single crystal silicon substrate, an insulating substrate having metal electrodes and metal projections may be employed or a structure having metal projections formed on a conductive substrate may be employed.

In the thus-structured unit light source in a state where the single crystal silicon substrate 101 is grounded through the substrate contact electrode 107, when anode voltage $V_{ak}$ is applied to the fluorescent member 106 through the anode contact electrode 110 and the anode electrode 109 and gate voltage $V_{gk}$ is applied to the gate electrode of the field emission devices 105 through the gate contact electrode 108, the electric field of the gate electrode is applied to the projection portions of the cathode electrode of the field emission devices 105 so that electrons are field-emitted from the leading portions of the projections. The field-emitted electrons are accelerated due to the anode voltage when allowed to reach the fluorescent member 106 so that the portions of the fluorescent member 106 opposite to the device emit light.

Thus-emitted light passes through the transparent anode electrode 109 and the second flat substrate 102 to be radiated so that image data for one line is emission-recorded on a recording medium, such as a film. In the foregoing case, the line sequential scan method may be employed as described above, in which the recording medium or the print head is moved to record image data for the following one line. When the RGB filter 124 is, as shown in FIG. 1, moved to perform main scanning, a color image can be recorded.

Since a field emission print head of the foregoing type is manufactured by using the microprocessing technique for semiconductors, high resolutions can be realized.

However, in the foregoing conventional field emission print head, electrons are emitted from the leading ends of the projecting cathode electrodes 111 for field-emitting electrons while being spread by an angular degree of about 60 degrees.

Therefore, somewhat spread electrons reach the anode. As a result, there is a risk that electrons collide with adjacent pixels in the anode portion, and thus there arises a problem in that leakage light emission takes place.

In order to prevent the foregoing problem, the pixel pitch is required to be elongated. However, elongation of the pixel pitch causes the resolution to deteriorate. Although the spread of electrons can be prevented by shortening the distance from the cathode to the anode, the distance cannot be shortened because the apparatus cannot withstand the operation voltage of hundreds of volts which is applied to the anode in the case where the distance from the cathode to the anode is shortened.

SUMMARY OF THE INVENTION

Accordingly, an object of the present invention is to provide a field emission print head capable of preventing leakage light emission without a necessity of reducing the distance from the cathode to the anode thereof.

To achieve the foregoing object, according to one aspect of the present invention, there is provided a field emission print head including: a plurality of stripe cathode lines formed on a cathode substrate; a plurality of stripe gate lines respectively formed on the cathode lines through an insulating layer; a gate lead electrode for connecting the gate lines to one another; field emission arrays formed in portions in which the cathode lines and the gate lines overlap; and an anode substrate formed opposite to the field emission array and having an anode line coated with a fluorescent member.

The field emission print head according to the present invention may have a structure such that a first gate lead electrode, to which odd order gate lines among the gate lines are connected, and a second gate lead electrode, to which even order gate lines among the gate lines are connected, respectively form a first gate electrode and a second gate electrode each having a comb-like shape.

The field emission print head according to the present invention may have a structure such that the anode electrode is disposed opposite to the cathode substrate, field emission arrays in a first line formed on the first gate electrode and field emission arrays in a second line formed on the second gate electrode are disposed in a zigzag configuration while being apart from one another for a predetermined distance, and potential of a non-selected gate lead electrode among the first gate electrode and the second gate electrode, which are alternately selected and operated, is made to be a low level.

The field emission print head according to the present invention may have a structure such that the anode lines are formed opposite to the gate lines and in parallel to the gate lines by the same number as that of the gate lines, a first anode lead electrode to which odd order anode lines among the anode lines are connected, a second anode lead electrode to which even order anode lines among the anode lines are connected, fluorescent members in a first line covering the odd order anode lines, and fluorescent members in a second line covering the even order anode lines are provided, the fluorescent members in the first line and the fluorescent members in the second line are disposed in a zigzag configuration while being apart from each other to correspond to the field emission arrays in the first line and the field emission arrays in the second line, and potential of a non-selected anode lead electrode among the first anode lead electrode and the second anode lead electrode, which are alternately selected and operated, is made to be a low level.

The field emission print head according to the present invention may have a structure such that the anode line consists of two anode lines formed opposite to the gate line and substantially perpendicular to the gate lines and two dummy anodes disposed on the two sides of the two anode lines, the fluorescent members in the first line are formed on either of the two anode lines to correspond to the field emission arrays in the first line, the fluorescent members in the second line are formed on the residual anode line of the two anode lines to correspond to the field emission arrays in the second line, and potential of a non-selected anode line of the two anode lines, which are alternately selected and operated, and either of the two dummy anodes, in which the anode line which is being selected and operated is interposed, is made to be a low level.

The field emission print head according to the present invention may have a structure further including a plurality of cathode lines formed on the cathode substrate; a plurality of gate lines respectively formed on the cathode lines through an insulating layer; a plurality of converging electrodes disposed between the gate lines and on the outside of two terminative ends of the gate lines; a first gate lead electrode to which the plural gate lines are connected; a second gate lead electrode to which the plural converging electrodes are connected; stripe and elongated field emission arrays respectively formed in portions in which the plural cathode lines and the plural gate lines overlap; and an anode substrate disposed opposite to the cathode substrate and having anode line electrodes coated with fluorescent members to correspond to the field emission arrays respectively formed on the gate lines, wherein the anode line electrode consists of an anode line formed opposite to the gate line in a direction substantially perpendicular to the gate line and two anode converging electrodes disposed on the two sides of the anode line, the anode line has a stripe fluorescent member formed in the axial direction thereof, potential of the second gate lead electrode is made to always be a low level, and potential of the two anode converging electrodes is made to always be a low level.

The field emission print head according to the present invention may have a structure such that the anode line is made of a thin metal film, the anode line having a slit formed in the axial direction thereof and coated with the fluorescent member to cover the slit.

The field emission print head according to the present invention may further comprise a plurality of cathode lines formed on the cathode substrate; a plurality of gate lines respectively formed on the cathode lines through an insulating layer; a plurality of converging electrodes disposed between the gate lines and on the outside of two terminative ends of the gate lines; a first gate lead electrode to which the plural gate lines are connected; a second gate lead electrode to which the plural converging electrodes are connected; stripe and elongated field emission arrays respectively formed in portions in which the plural cathode lines and the plural gate lines overlap; and an anode substrate disposed opposite to the cathode substrate and having anode line electrodes coated with fluorescent members to correspond to the field emission arrays respectively formed on the gate lines, wherein the anode line electrode consists of an anode line formed opposite to the gate line in a direction substantially perpendicular to the gate line and two anode converging electrodes disposed on the two sides of the anode line, the anode line has a stripe fluorescent member formed in the axial direction thereof, potential of the second gate lead electrode is made to always be a low level, and potential of the two anode converging electrodes is made to always be a low level.

The field emission print head according to the present invention may have a structure such that the anode line is made of a thin metal film, the anode line having a slit formed in the axial direction thereof and coated with the fluorescent member to cover the slit.

The field emission print head according to the present invention may have a structure such that the converging electrode is disposed higher than the gate lines so that the converging electrode is disposed adjacent to the anode substrate.

According to the present invention, when the odd order gate lines and the even order gate lines are alternately selected and operated, the potential of the non-selected gate line is made to be a low level. Therefore, the selected and operated gate line is disposed between low potential gate lines so that field-emitted electrons are converged.

Moreover, since the selected and operated anode line in the anode portion is disposed between the low potential dummy anodes, also the anode portion is enabled to converge electrons.

Therefore, leakage light emission from the adjacent pixels can be prevented while maintaining the resolution and preventing brightness from being lowered by lowering the anode potential.

Since the field emission array is formed into a stripe shape, the permissible range for positioning the anode substrate with respect to the cathode substrate can be widened when the cathode substrate and the anode substrate are bonded to each other. As a result, the field emission print head can easily be manufactured.

Moreover, the potential of the converging electrodes disposed between gate lines and on the outside of the two terminative ends of the gate line is made to be a low potential when the gate line is operated. Therefore, the operated gate line is disposed between low potential converging electrodes so that field-emitted electrons are converged.

Since the operated anode line in the anode portion is disposed between the low potential anode converging electrodes, also the anode portion is enabled to converge electrons.

Other objects, features and advantages of the invention will be evident from the following detailed description of the preferred embodiments described in conjunction with the attached drawings.

BRIEF DESCRIPTION OF THE DRAWINGS

FIG. 5 is a perspective view showing the structures of the gate line, the cathode line and an anode line of the field emission print head according to the first embodiment of the present invention;

FIGS. 6(*a*)–(*f*) are timing charts of operation pulses for operating the field emission print head according to the present invention;

DETAILED DESCRIPTION OF THE PREFERRED EMBODIMENTS

Figure 1:
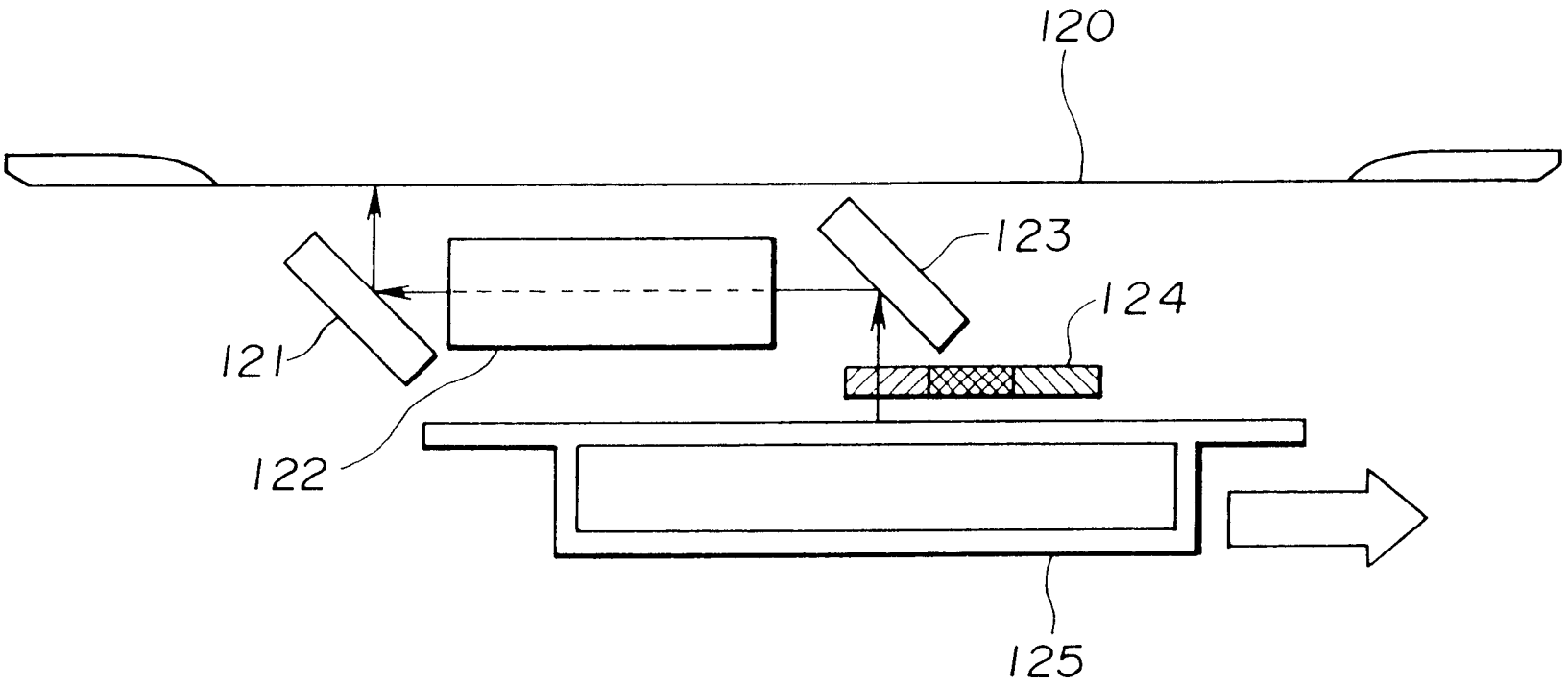
FIG.1 (PRIOR ART)
FIG. 1 is a schematic view showing the structure of a conventional optical printer.
Figure 2A:
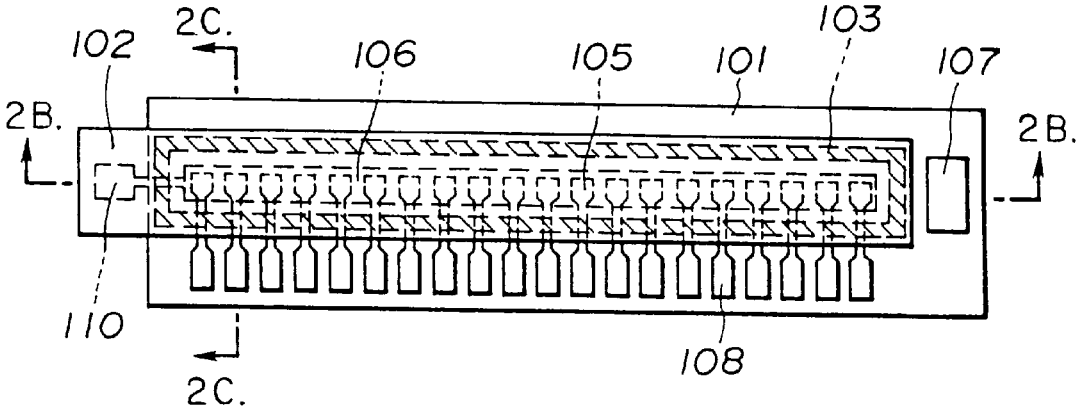
FIG.2A (PRIOR ART)
FIGS. 2A, 2B and 2C consists of a top view, a front cross sectional view and a side-cross sectional view, respectively, showing the schematic structure of a conventional field emission print head.
Figure 2B:
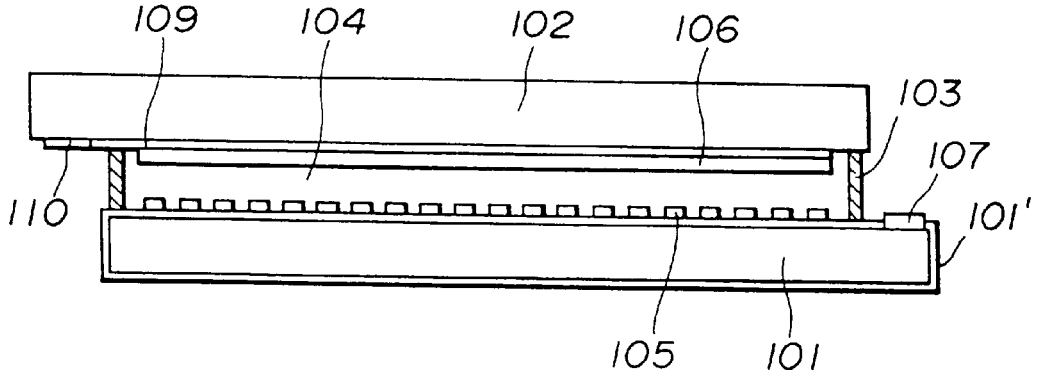
FIG.2B (PRIOR ART)
Figure 2C:
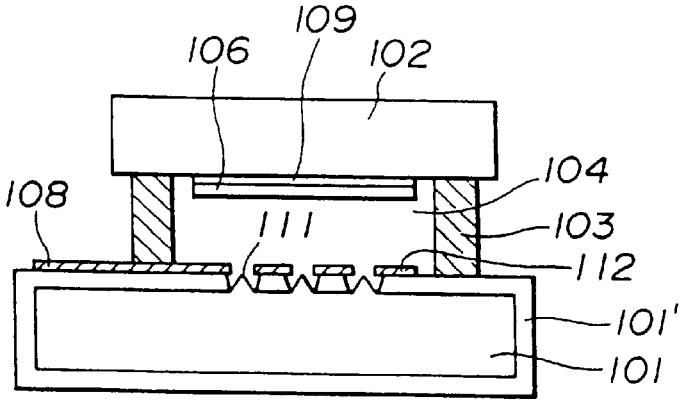
FIG.2C (PRIOR ART)
Figure 3:
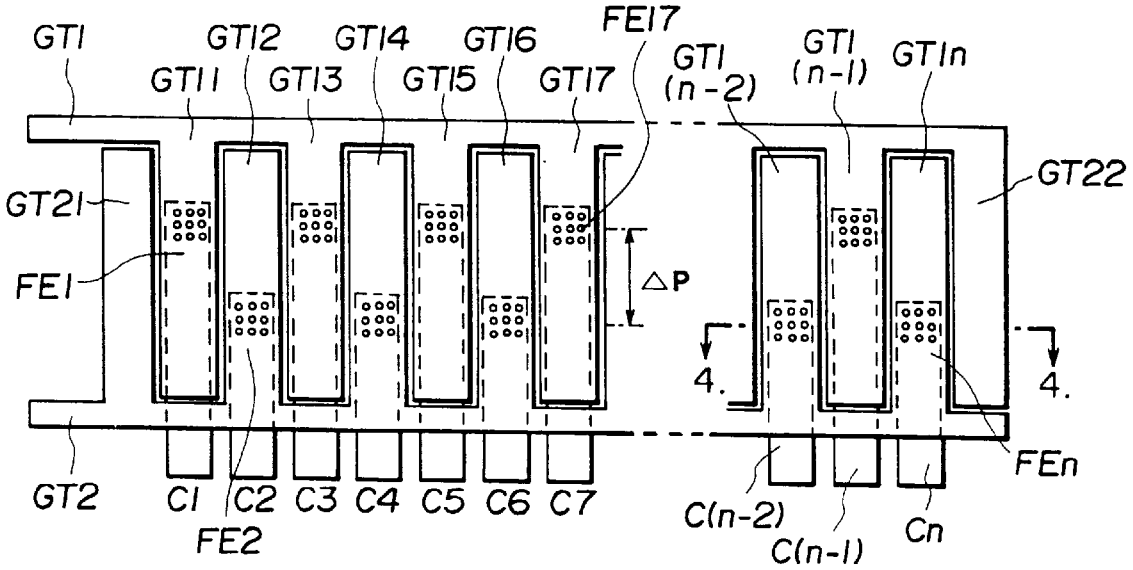
FIG. 3 is a perspective view showing the structures of a gate line and a cathode line of a field emission print head according to a first embodiment of the present invention.
Figure 4:
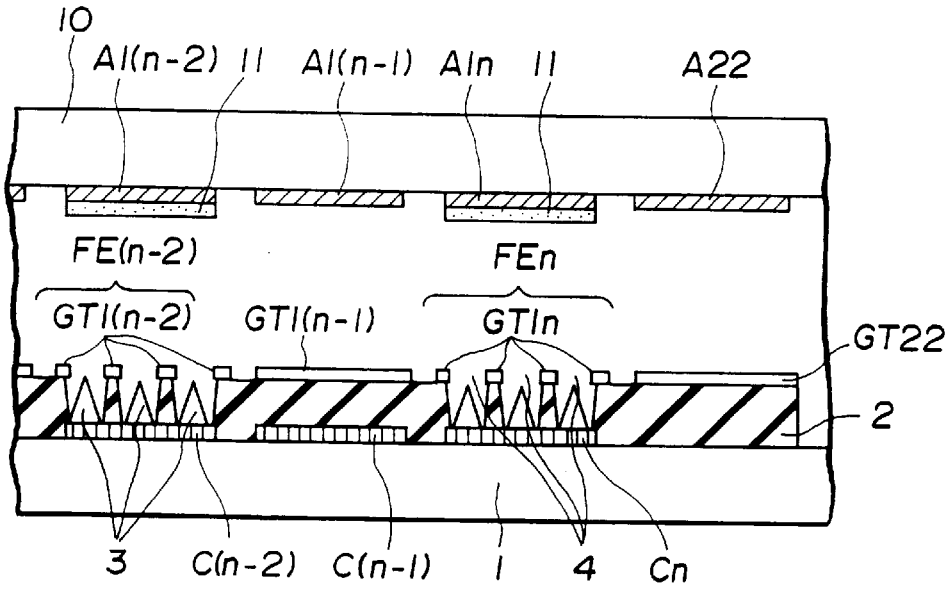
FIG. 4 is a partial side cross sectional view showing the structure of the field emission print head according to the first embodiment of the present invention.

A first embodiment of a field emission print head according to the present invention will now be described with reference to FIGS. 3 to 6. FIG. 3 shows examples of gate lines and cathode lines when a cathode substrate 1 forming the field emission print head according to the first embodiment is viewed from an upper position. FIG. 4 is a partial cross sectional view of the field emission print head according to the first embodiment and taken along line 4—4 shown in FIG. 3. FIG. 5 is a perspective view showing the field emission print head according to the first embodiment, in which structures of the gate lines, cathode lines and anode lines are illustrated. FIG. 6 is a timing chart for operating the field emission print head according to the first embodiment.

The field emission print head according to the first embodiment of the present invention, as shown in FIG. 4, has a plurality of cathode lines C1, C2, C3, . . . , Cn (only three cathode lines C (n−2), C (n−1) and Cn are illustrated) formed into a stripe configuration on one surface of the cathode substrate 1. On the cathode lines C1, C2, C3, . . . , Cn, there are formed a plurality of cone-like emitters 3 for respectively forming field emission arrays. On the cathode substrate 1, there is formed an insulating layer 2 made of SiO2 and so forth. On the insulating layer 2, there are formed n gate lines GT11 to GT1n (only ten gate lines GT11 to GT17, . . . , GT1 (n−2), GT1 (n−1) and GT1n are illustrated), and dummy gates GT21 and GT22 on the two sides of the gate lines GT11 to GT1n. Odd order gate lines GT11, GT13, GT15, GT17, . . . , GT1 (n−1) among the gate lines GT11 to GT1n and the dummy gate GT22 are, by a first gate lead electrode GT1, connected in the comb like configuration. Also the even order gate lines GT1n and the dummy gate 21 are connected by the second gate lead electrode GT2 in the comb like configuration.

The field emission cathodes FE1 to FEn are constituted by the cathode lines C1 to Cn, gate lines GT11 to GT1n and the emitters 3. The field emission cathodes FE1, FE3, . . . , FE (n−1) constituted by the odd order gate lines GT11, GT13, . . . , GT (n−1) are, as illustrated, disposed in a line. Moreover, the field emission cathodes FE2, FE4, . . . , FEn constituted by the even order gate lines GT12, GT14, . . . , GTn are disposed in a line. The intervals between the field emission cathodes is made to be ΔP (see FIG. 3).

As a result, the field emission cathodes FE1 to FEn are, as shown in FIG. 3, disposed into a zigzag configuration.

An anode substrate 10 is disposed opposite to the cathode substrate 1 and apart from the same for a predetermined distance. The anode substrate 10 has n anode lines A11 to A1n (only three anode lines A1 (n−2), A2 (n−1) and A1n are illustrated), which is the same number as that of the gate lines. Moreover, the anode substrate 10 has dummy anodes A21 and A22 (only the dummy anode A22 is illustrated) on the two sides of the anode lines A11 to A1n. The odd order anode lines A11, A13 and A1 (n−1) among the anode lines A11 to A1n are, as shown in FIG. 5, connected to the first anode lead electrode A1. On the other hand, the even order anode lines A12, A14 and A1n among the anode lines are connected to a second anode lead electrode A2. As described above, the structure of the electrodes in the anode portion is similar to that of the electrodes in the gate portion, as shown in FIG. 5.

The n anode lines A11 to A1n are coated with dot-like fluorescent members 11 at positions opposite to the field emission cathodes FE1 to FEn formed on the cathode substrate 1. Therefore, the dot-like fluorescent members 11 are disposed into a zigzag configuration as shown in FIG. 5.

Since the field emission cathodes FE1 to FEn and the dot-like fluorescent members 11 are disposed into the zigzag configuration, the distance between adjacent pixels can be elongated. As a result, leakage light emission of the adjacent dot-like fluorescent members 11 occurring due to electrons emitted from the field emission cathode can be prevented.

The cathode substrate 1, the anode substrate 10 and side plates (not shown) form a vacuum airtight container, the inside of which is made to be high vacuum. To obtain light emitted from the dot-like fluorescent members 11 through the anode substrate 10, the anode substrate 10 is made of glass. Note that also the cathode substrate 1 may be made of glass.

The anode lines A11 to A1n and the anode lead electrodes A1 and A2 are usually made of a transparent conductive material, such as ITO. However, a thin metal film, made of aluminum or the like may be employed. In this case, a window is formed in the anode lines A11 to A1n coated with the dot-like fluorescent members 11 to take out light emitted from the dot-like fluorescent members 11 through the window. To prevent reflection due to the thin metal film, such as a thin aluminum film, a titanium oxide film may be formed in the interface between the anode substrate 10 and the thin aluminum film to be formed into a reflection preventive film. As a result, light exhibiting high contrast can be obtained.

A method of operating the field emission print head according to the first embodiment and having the foregoing structure will now be described with reference to a time chart of operation pulses shown in FIG. 6.

As described above, the odd order gate lines GT11, GT13, GT15, . . . , GT1 (n−1) among the n gate lines GT11 to GTn are connected to the first gate lead electrode GT1. On the other hand, the even order gate lines GT12, GT14, GT16, . . . , GT1n among the n gate lines GT11 to GTn are connected to the second gate lead electrode GT2. Thus, the first gate lead electrode GT1 and the second gate lead elect rode GT2 are, as shown in FIGS. 6A and 6B, alternately selected and operated. In the foregoing case, the potential of the non-selected gate lead electrodes is made to be a low level (or zero level or a negative level).

When the first gate lead electrode GT1 is selected and operated for example, the potential of each of the gate lines GT12 and GT14 on the two sides of, for example, the gate line GT13 is made to be the low level. As a result, an influence of the thus-formed electric fields of the low level gate lines GT12 and GT14 prevents dispersion of electrons emitted from the gate line GT13 but the electrons are converged.

Thus, when the first gate lead electrode GT1 has been selected and operated, electrons emitted from the odd-order gate lines GT11, GT13, GT15, . . . , GT1 (n−1) are converged. When the second gate lead electrode GT2 has been selected and operated, the low level potential (or zero level or a negative level) of the odd order gate lines GT11, GT13, GT15, . . . , GT1 (n−1) causes electrons emitted from the even order gate lines GT12, GT14, GT16, . . . , GT1n to be converged.

Since no gate line exists on the outside of each of the gate line GT11 and the gate line G1n, dummy gates GT21 and GT22 are provided to converge electrons.

Also the anode lead electrode A1, to which the odd order anode lines A11, A13, . . . , A1 (n−1) are connected, and the second anode lead electrode A2, to which the even order anode lines A12, A14, . . . , A1n are connected, are, as shown in FIGS. 6C and 6D, alternately selected and operated.

In this case, the pulse for operating the first anode lead electrode A1 and that for operating the first gate lead electrode GT1 are synchronized with each other, while the pulse for operating the second anode lead electrode A2 and that for operating the second gate lead electrode GT2 are synchronized with each other.

As a result, the first gate lead electrode GT1 is operated so that electrons emitted from the odd order gate lines GT11, GT13, GT15, . . . , GT1 (n−1) collide with the dot-like fluorescent members 11 covering the odd order anode lines A11, A13, . . . , A1 (n−1) because the opposite first anode lead electrode A1 is operated. Thus, the dot-like fluorescent members 11 emit light.

At this time, odd order image data for one line has been supplied to the odd order cathode electrodes C1, C3, . . . , C (n−1), as shown in FIG. 6E. Thus, light emission of the dot-like fluorescent members 11 covering the odd order anode lines A11, A13, . . . , A1 (n−1) is controlled in accordance with the image data.

When the first anode lead electrode A1 has been selected and operated, the potential of the non-selected second anode lead electrode A2 is made to be a low level (or zero level or a negative level).

In the case of the anode line A13 for example, the potential of the anode line A12 and the anode line A14 disposed on the two sides of the anode line A13 is made to be a low level. As a result, the influence of the low level anode lines A12 and A14 disposed on the two sides of the anode line A13 causes electrons, allowed to reach the anode line A13, to be converged. Therefore, electrons emitted from the odd order gate lines GT11, GT13, GT15, . . . , GT1 (n−1) are further converged and then allowed to reach the odd order anode lines A11, A13, . . . , A1 (n−1).

Then, the second gate lead electrode GT2 is operated so that electrons emitted from the even order gate lines GT12, GT14, GT16, . . . , GT1n collide with the dot-like fluorescent members 11 covering the even order anode lines A12, A14, . . . , A1n because the opposite second anode lead electrode A2 is operated. Thus, the corresponding fluorescent members 11 emit light.

At this time, even order image data for one line has been supplied to the even order cathode electrodes C2, C4, . . . , Cn is, as shown in FIG. 6F. Thus, light emission from the dot-like fluorescent members 11 covering the even order anode lines A12, A14, . . . , A1n is controlled in accordance with the image data.

When the second anode lead electrode A2 has been selected and operated, the potential of the non-selected first anode lead electrode A1 is made to be a low level (or zero level or a negative level). Thus, electrons emitted from the even order gate lines GT12, GT14, GT16, . . . , GT1n are further converged when allowed to reach the even order anode lines A12, A14, . . . , A1n.

As a result, a light emission signal of an image for one line can be fetched from the print head so that an image for one line is recorded on a recording medium. Then, line sequential scanning is sequentially performed similarly so that an image for one image screen is light-emission recorded on the recording medium.

The field emission arrays FE1, FE3, . . . , FE (n−1) on the odd order gate lines GT11, GT13, GT15, . . . , GT1 (n−1) and the field emission arrays FE2, FE4, . . . , FEn on the even order gate lines GT12, GT14, GT16, . . . , GT1n are disposed apart from one another for a distance of ΔP to prevent leakage light emission. Therefore, image data for line and to be supplied to the even order cathode lines C2, C4, . . . , Cn is, by a degree corresponding to the distance ΔP, delayed from image data for one line and to be supplied to the odd order cathode lines C1, C3, . . . , C (n−1).

In this case, the operation of the even order anode lines A12, A14, . . . , A1n is delayed by a half period of one display period as compared with the odd order anode lines A11, A13, . . . , A1n. In consideration of the delay, it is preferable that the distance ΔP be determined with which image data delayed by integer number lines can be supplied to the even order cathode lines C2, C4, . . . , Cn to easily supply image data.

Figure 7:
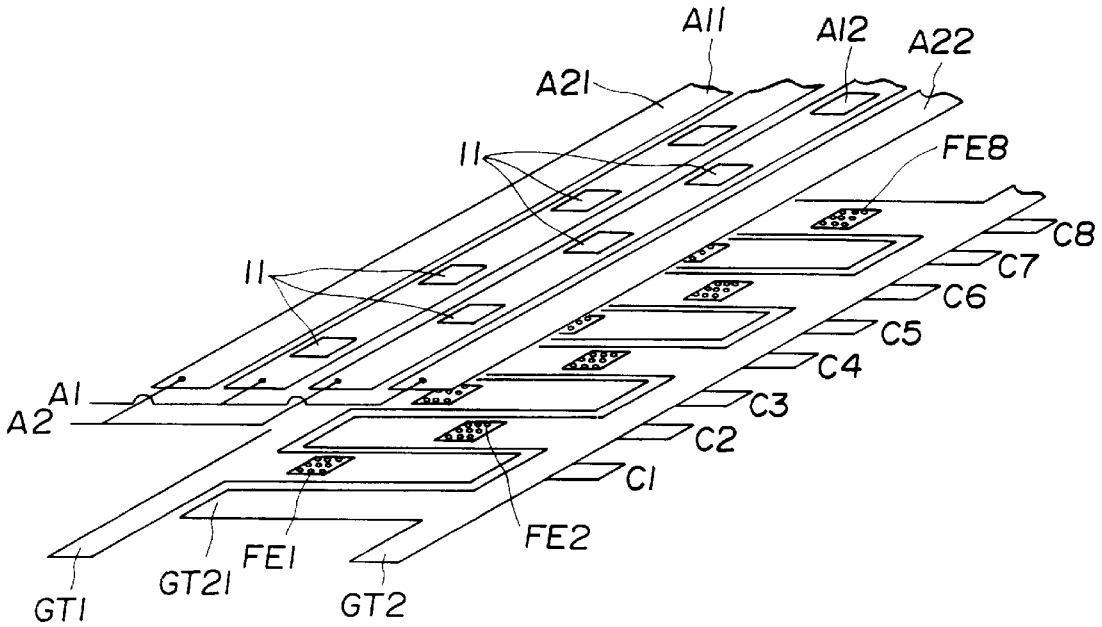
FIG. 7 is a perspective view showing the structures of a gate line, a cathode line and an anode line of the field emission print head according to a second embodiment of the present invention.

The structure of the field emission print head according to a second embodiment of the present invention is shown in FIG. 7. FIG. 7 is a perspective view of the field emission print head according to the second embodiment of the present invention, in which the structures of gate lines, cathode lines and anode lines are illustrated and the cathode substrate and the anode substrate are omitted from illustration.

The second embodiment is different from the first embodiment in the structure of the anode portion. Since the structure of the cathode portion is the same as that of the first embodiment, the cathode portion is omitted from description.

The anode portion consists of two anode lines A11 and A12 in the form of stripes disposed substantially perpendicular to the gate lines GT11 to GT1n; and two dummy anodes A21 and A22 disposed on the two sides of the anode lines A11 and A12.

The anode line A1 and the anode line A2 respectively are coated with the dot-like fluorescent members 11. The dot-like fluorescent members 11 covering the anode line A1 are formed opposite to the field emission arrays FE1, FE3, . . . , FE (n−1) formed on the odd order gate lines GT11, GT13, GT15, . . . , GT1 (n−1). The dot-like fluorescent members 11 covering the anode line A2 are formed opposite to the field emission arrays FE2, FE4, . . . , FEn formed on the even order ate lines GT12, GT14, GT16, . . . , GT1n.

The anode line A11 and the dummy anode A22 are connected to the first anode lead electrode A1, while the anode line A12 and the dummy anode A21 are connected to the second anode lead electrode A2. As a result, the field emission print head can effectively be operated as follows:

The first anode lead electrode A1 and the second anode lead electrode A2 are selected and operated similarly to those according to the first embodiment at the timing shown in FIGS. 6C and 6D. When, for example, the first anode lead electrode A1 is operated, anode operation voltage is applied to the anode line A11. The potential of the non-selected anode line A12 is made to be a low level (or zero level or a negative level). Since the anode line A11 is disposed between the low level anode line A12 and the dummy anode A21, the effect of the electric field causes electrons emitted from the odd order gate lines GT11, GT13, . . . , GT1 (n−1) to be converged and then allowed to reach the anode line A11.

In this case, the direction of conversion is perpendicular to the anode lines A11 and A12. However, the effects of the odd order gate lines GT11, GT13, . . . , GT1 (n−1) and the even order gate lines GT12, GT14, . . . , GT1n cause electrons to be converged in a direction in parallel to the anode lines A11 and A12. Therefore, electrons emitted from the selected and operated field emission arrays are effectively converged to have a circular converging cross section. That is, the effect of converging emitted electrons can be improved.

Figure 8:
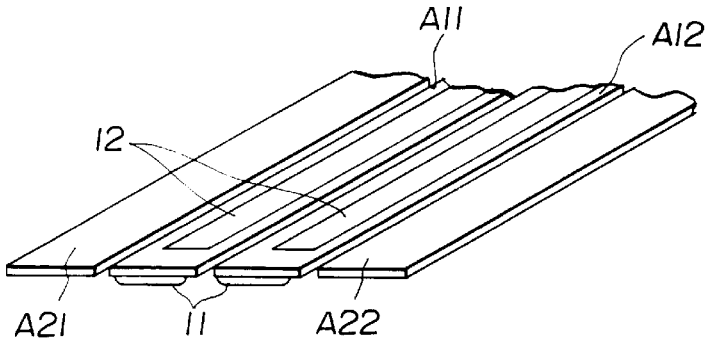
FIG. 8 is a diagram showing a modification of the second embodiment of the field emission print head according to the present invention.

A modification of the anode portion of the second embodiment is shown in FIG. 8.

The anode lines A11 and A12 and the dummy anodes A21 and A22 shown in FIG. 5 are usually made of the transparent conductive materials, such as ITO. The anode lines A11 and A12 and dummy anodes A21 and A22 shown in FIG. 8 are in the form of thin metal films made of aluminum or the like. Since the anode lines A11 and A12 do not permit light penetration, an elongated slit 12 is formed in each of the anode lines A11 and A12 in the axial direction. Moreover, the fluorescent members 11 are formed to cover the slits 12. As a result, light emitted by the fluorescent members 11 can be obtained through the slits 12.

Also the anode lines A11 and A12 and the dummy anodes A21 and A22 shown in FIG. 7 may be thin metal films made of, for example, aluminum. In the foregoing case, a window is formed in the anode lines A11 and A12 covered with the dot-like fluorescent members 11 to obtain light emitted by the dot-like fluorescent members 11 through the window.

In the case where the anode lines A11 and A12 and the dummy anodes A21 and A22 are made of aluminum thin films or the like, reflection is required to be prevented by forming a titanium oxide film in the interface between the anode substrate 10 and the aluminum thin film to form a reflection preventive layer. As a result, light exhibiting high contrast can be obtained.

Since a precise light emission pattern can be obtained while requiring a thin film structure because the window or the slit is formed in the anode lines A11 and A12 made of the thin metal film, the permissible range for patterning the fluorescent members 11 can be widened. Therefore, the fluorescent members 11 can easily be manufactured.

Since the field emission print head according to this embodiment has the structure such that the odd order cathode lines C1, C3, . . . , C (n−1) of the cathode lines C1 to Cn and the even order cathode lines C2, C4, . . . , Cn of the same are alternately selected and operated, the adjacent odd order cathode line and the even order cathode line may be connected to be operated by one cathode driver. With the foregoing structure, the number of the cathode drivers can be halved.

Figure 9:
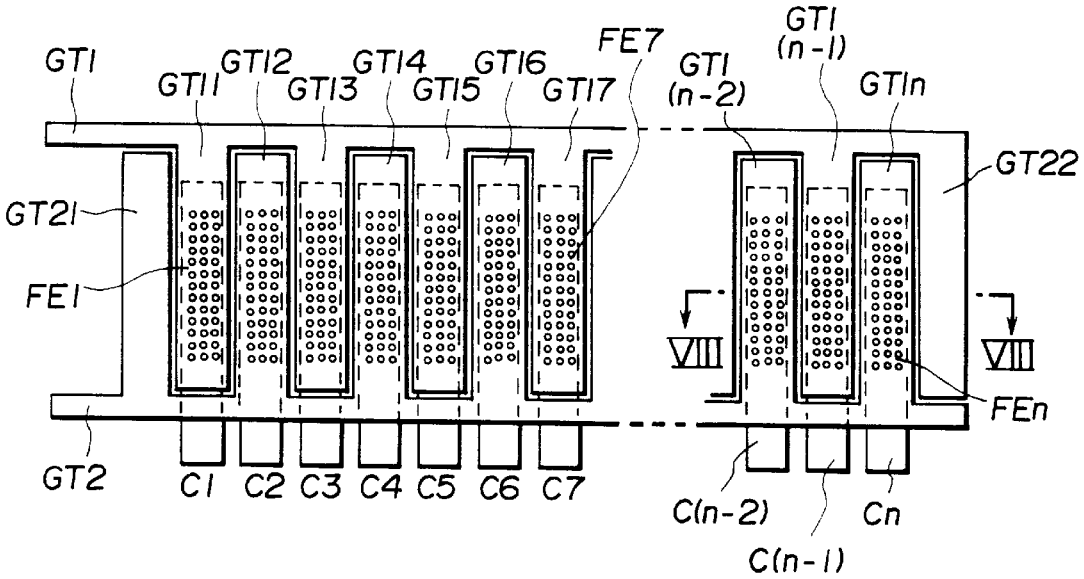
FIG. 9 is a perspective view showing the structures of a gate line and a cathode line of the field emission print head according to a third embodiment of the present invention.
Figure 10:
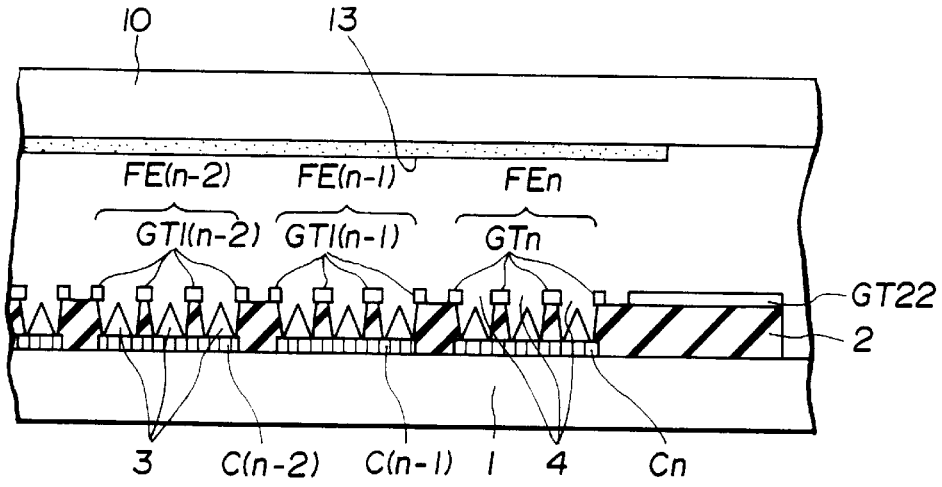
FIG. 10 is a partial side cross sectional view showing the structure of the third embodiment of the field emission print head according to the present invention.
Figure 11:
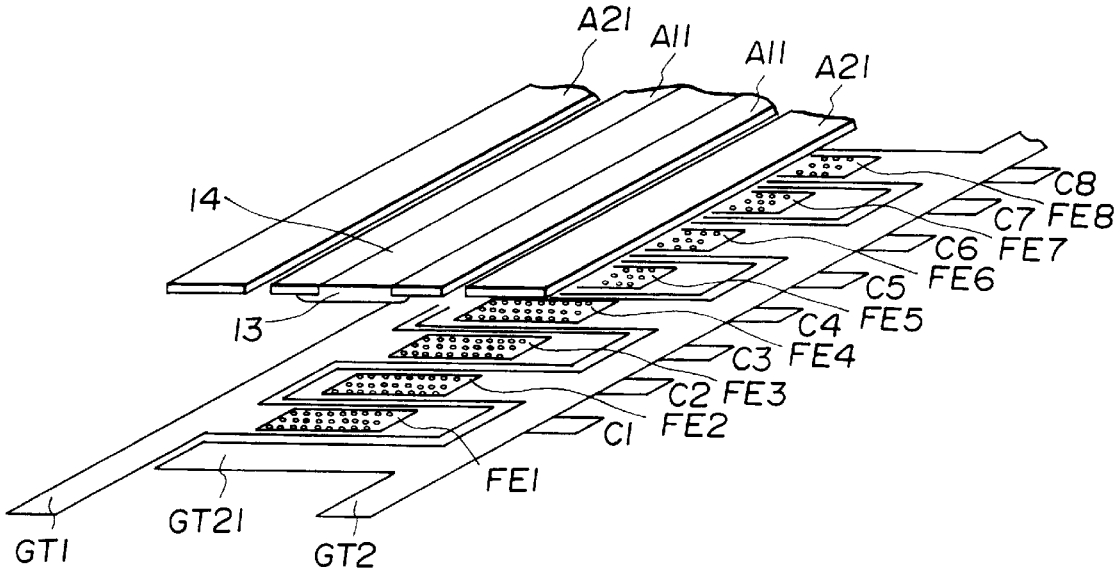
FIG. 11 is a perspective view showing the structures of the gate line, the cathode line and an anode line of the field emission print head according to the third embodiment of the present invention.

A third embodiment of the field emission print head according to the present invention will now be described with reference to FIGS. 9 to 11. FIG. 9 shows examples of gate lines and cathode lines when the cathode substrate 1 constituting the field emission print head according to this embodiment is viewed from an upper position. FIG. 10 is a partial cross sectional view of the field emission print head according to the present invention and taken along line VIII—VIII shown in FIG. 9. FIG. 11 is a perspective view of the field emission print head according to the present invention, in which the structures of the gate lines, the cathode lines and anode lines are illustrated.

The field emission print head according to the present invention, as shown in FIG. 10, has a plurality of cathode lines C1, C2, C3, . . . , Cn (only three cathode lines C (n−2), C (n−1) and Cn are illustrated) on one surface of the cathode substrate 1. On the cathode lines C1, C2, C3, . . . , Cn, there are formed a plurality of cone-like emitters 3 for respectively forming field emission arrays. On the cathode substrate 1, there is formed an insulating layer 2 made of SiO2 and so forth. On the insulating layer 2, there are formed n gate lines GT11 to GT1n (only three gate lines GT1 (n−2), GT1 (n−1) and GT1n are illustrated), and dummy gates GT21 and GT22 disposed on the two sides of the gate lines GT11 to GT1n.

The cathode lines C1 to Cn, the gate lines GT11 to GT1n and the emitters 3 constitute the field emission arrays FE1 to FEn. The field emission array FE1, FE3, . . . , FE (n−1) are formed into elongated stripe configuration as shown in FIG. 3.

The anode substrate 10 is disposed opposite to the cathode substrate 1 while being apart from the same for a predetermined distance. The anode portion is, as shown in FIG. 11, composed of an anode line A11 disposed substantially perpendicular to the gate lines GT11 to GT1n and having a stripe-shape slit 14; and two dummy anodes A21 disposed on the two sides of the anode line A11.

The anode line A11 has the slit 14 through which light emitted from the fluorescent member 13 is taken out. To cover the slit 14, a stripe shape fluorescent member 13 is applied. The anode line A11 and the dummy anode A21 are thin metal films made of, for example, aluminum.

The fluorescent member 13 emits light when electrons emitted from the field emission cathodes FE1 to FEn collide with the fluorescent member 13. Since the field emission cathodes FE1 to FEn are formed into a stripe configuration in a direction substantially perpendicular to the anode line A11, the permissible range for positioning the anode substrate 10 with respect to the cathode substrate 1 can be widened when the cathode substrate 1 and the anode substrate 10 are applied to each other to manufacture the field emission print head.

Since the slit 14 is formed in the anode line A11 made of the thin metal film, a precise light emission pattern can be obtained from a thin film structure. Therefore, a permissible range for patterning the fluorescent member 13 can be widened.

Therefore, the field emission print head according to the present invention can easily be manufactured.

The cathode substrate 1, the anode substrate 10 and side plates (not shown) form a vacuum and airtight container, the inside of which is high vacuum. Since light emission from the fluorescent member 13 is taken out through the anode substrate 10, the anode substrate 10 is made of glass. Also the cathode substrate 1 may be made of glass.

Since the anode line A11 and the dummy anode A21 made of thin film made of metal, such as aluminum, has a large reflectance, a titanium oxide film may be formed in the interface between the anode substrate 10 and the aluminum portion to form a reflection protective layer in order to prevent reflection of the thin metal film, such as the thin aluminum film. As a result, light emission exhibiting high contrast can be obtained.

Figure 12:
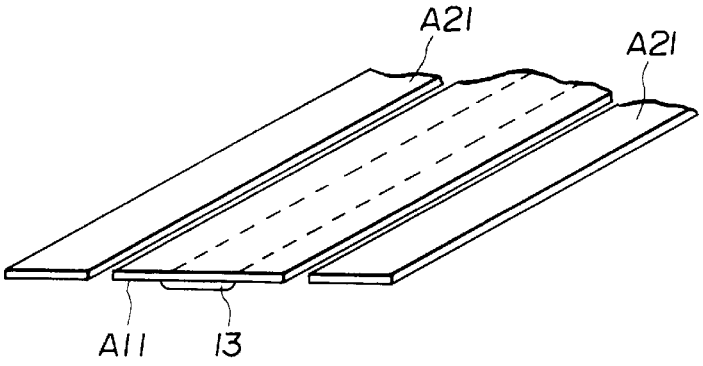
FIG. 12 is a diagram showing a modification of the third embodiment of the field emission print head according to the present invention.

The anode line A11 and the dummy anode A21 may be made of a transparent and conductive material, such as ITO. FIG. 12 shows the structure of the anode portion in the foregoing case. Since the anode line A11 is transparent, the slit 14 may be omitted from the structure. As shown in FIG. 12, the stripe fluorescent member 13 is formed below the anode line A11.

A method of operating the field emission print head having the foregoing structure and according to the third embodiment will now be described with reference to a timing chart of the operation pulses shown in FIG. 13.

Figures 13A, 13B, 13C, 13D, 13E, 13F:
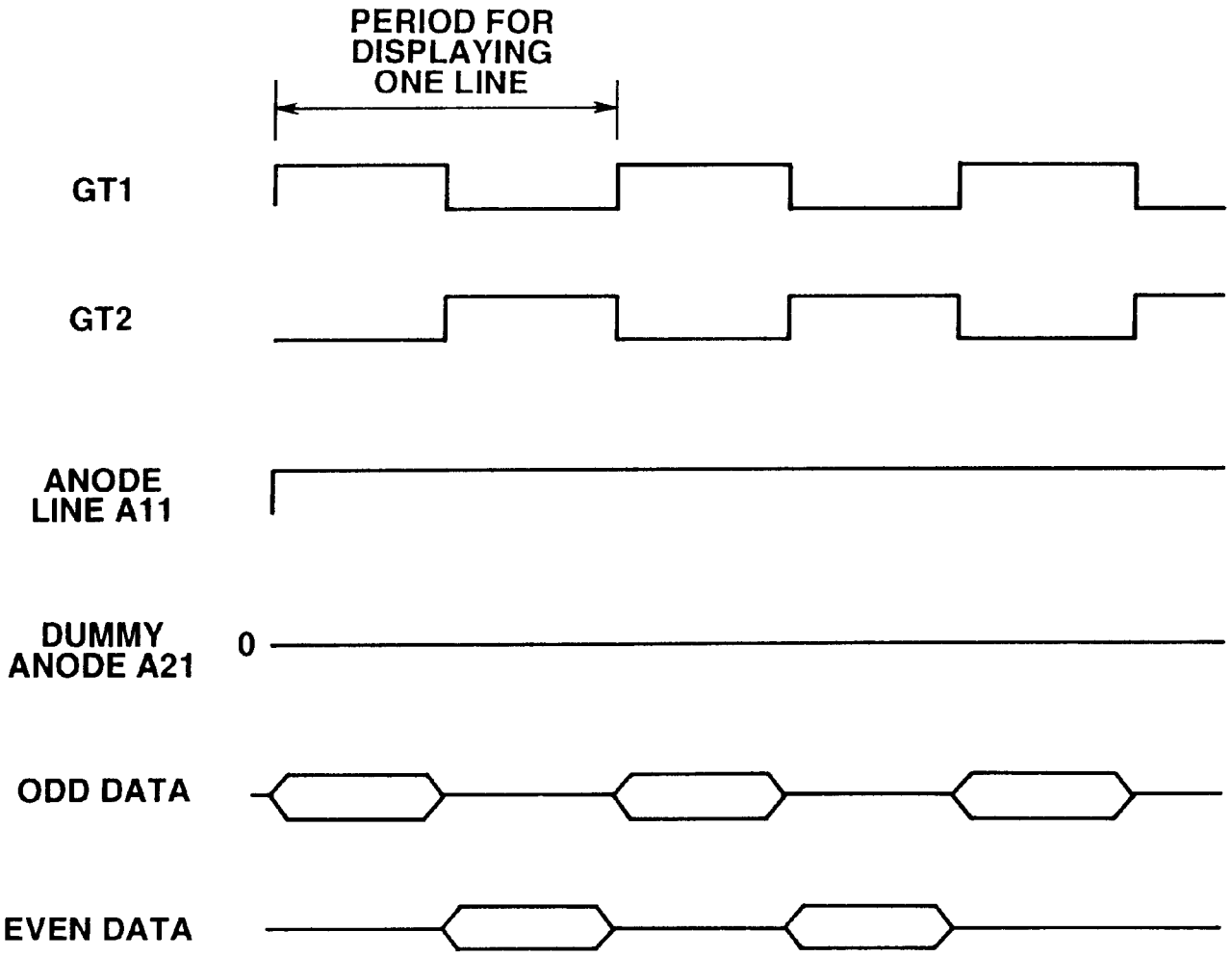
FIGS. 13(*a*)–(*f*) are timing charts of operation pulses for operating the field emission print head according to the third embodiment of the present invention.

As described above, the odd order gate lines GT11, GT13, GT15 . . . , GT1 (n−1) among the n gate lines GT11 to GTn are connected to the first gate lead electrode GT1. The even order gate lines GT12, GT14, GT16 . . . , GT1n among the n gate lines GT11 to GTn are connected to the second gate lead electrode GT2. The first gate lead electrode GT1 and the second gate lead electrode GT2 are alternately selected and operated at an interval of a half period of one display period, as shown in FIGS. 13A and 13B. The potential of the non-selected gate lead electrode is, in this case, made to be a low level (or zero level or a negative level).

When the first gate lead electrode GT1 is selected and operated for example, the potential of each of the gate lines GT12 and GT14 on the two sides of, for example, the gate line GT13 is made to be the low level. As a result, an influence of the thus-formed electric fields of the low level gate lines GT12 and GT14 prevents dispersion of electrons emitted from the gate line GT13 but the electrons are converged.

Thus, when the first gate lead electrode GT1 has been selected and operated, electrons emitted from the odd-order gate lines GT11, GT13, GT15, . . . , GT1 (n−1) are converged. When the second gate lead electrode GT2 has been selected and operated, the low level potential (or zero level or a negative level) of the odd order gate lines GT11, GT13, GT15, . . . , GT1 (n−1) causes electrons emitted from the even order gate lines GT12, GT14, GT16, . . . , GT1n to be converged.

Since no gate line exists on the outside of each of the gate line GT11 and the gate line G1n, dummy gates GT21 and GT22 are provided to converge electrons.

In the anode portion, the operation voltage is, as shown in FIG. 13C, always supplied to the anode line A11 and the dummy anode A21 is always supplied with a low level potential (a zero potential is illustrated, and the potential may be a negative potential) as shown in FIG. 13D.

Since the anode line A11 is disposed between the low level dummy anodes A21, the effect of the electric field causes electrons emitted from the gate lines GT11 to GT1n to be converged and then allowed to reach the anode line A11. In this case, the direction of electron conversion is perpendicular to the anode line A11. However, the effects of the odd order gate lines GT11, GT13, . . . , GT1 (n−1) and the even order gate lines GT12, GT14, . . . , GT1n cause electrons to be converged in a direction in parallel to the anode line A11. Therefore, electrons emitted from the selected and operated field emission arrays are effectively converged to have a circular converging cross section.

When the first gate lead electrode GT1 has been selected and operated, the odd order cathode lines C1, C3, . . . , C (n−1) have been supplied with odd order image data for one line as shown in FIG. 13E. Thus, the light emission of the fluorescent member 13 covering the anode line A11 is controlled in accordance with the image data.

When the second gate lead electrode GT2 is operated, the even order cathode lines C2, C4, . . . , Cn is supplied with even order image data for one line as shown in FIG. 13F. Thus, the light emission of the fluorescent member 13 covering the anode line A11 is controlled in accordance with the image data.

As described above, the first gate lead electrode GT1 is selected and operated, and then the second gate lead electrode GT2 is selected and operated so that an image for one line is recorded on a recording medium. Then, line sequential scanning is sequentially performed similarly so that an image for one image screen is recorded on the recording medium.

In the foregoing field emission print head, the odd order cathode lines C1, C3, . . . , C (n−1) of the cathode lines C1 to Cn and the even order cathode lines C2, C4, . . . , Cn of the same are alternately selected and operated. Therefore, the adjacent odd order cathode line and the even order cathode line may be connected to each other so as to be operated by one cathode driver. As a result, the number of the cathode drivers can be halved.

Figure 14:
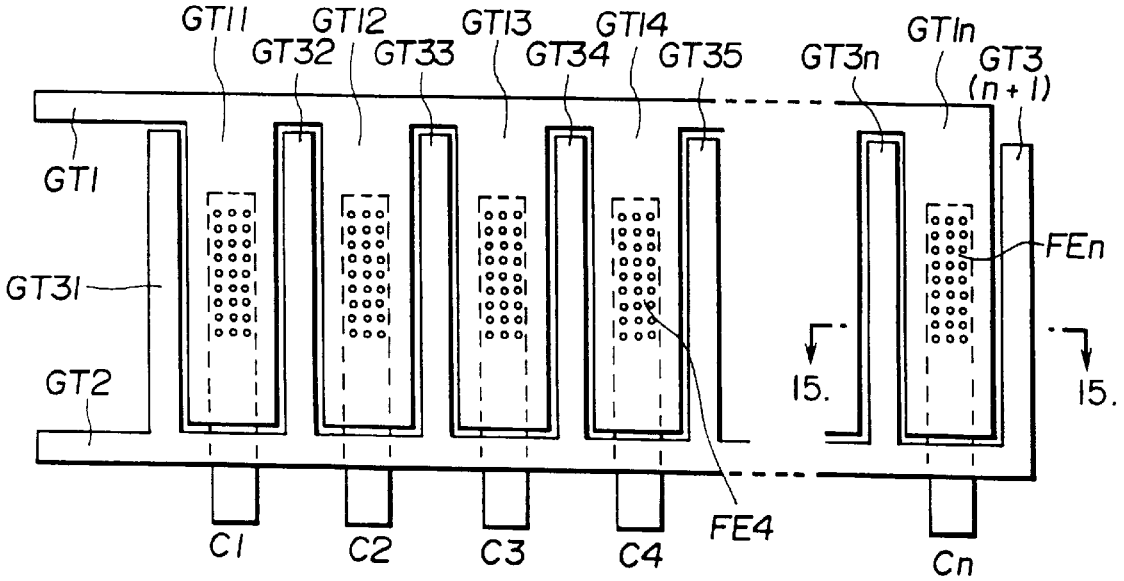
FIG. 14 is a perspective view showing a gate line and a cathode line of the field emission print head according to a fourth embodiment of the present invention.
Figure 15:
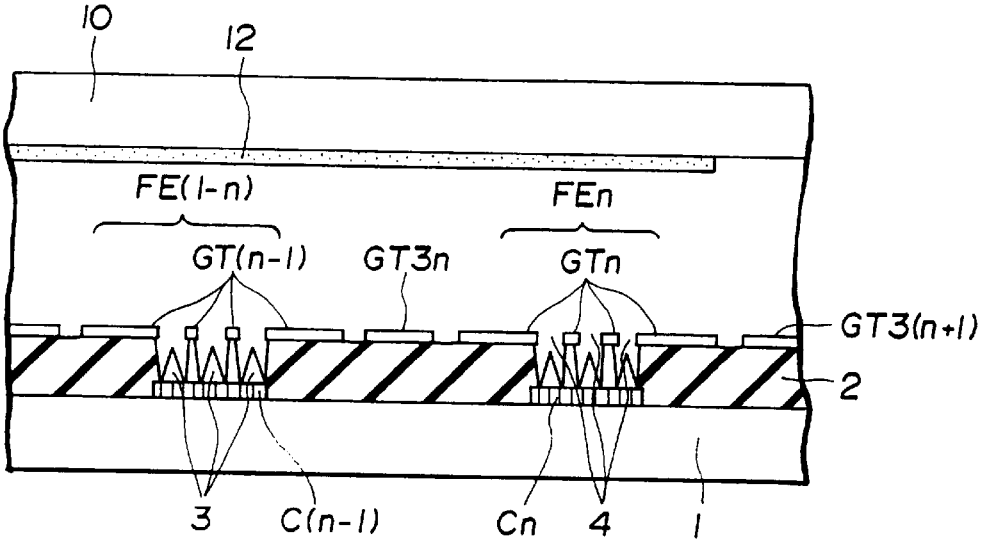
FIG. 15 is a partial side cross sectional view showing the structure of the field emission print head according to the fourth embodiment of the present invention.
Figure 16:
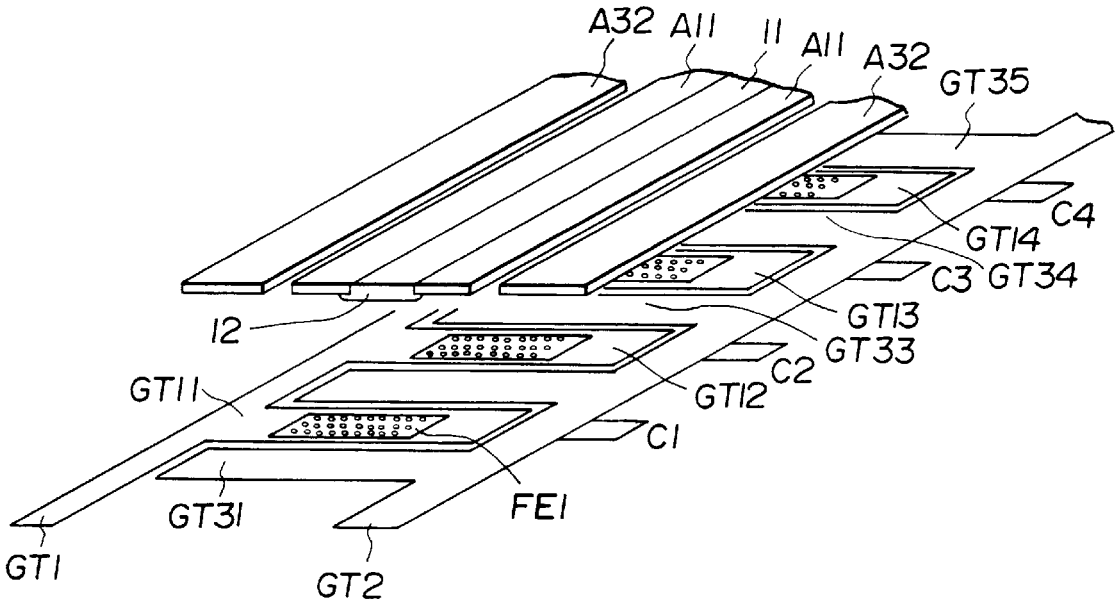
FIG. 16 is a perspective view showing the structures of the gate line, the cathode line and an anode line of the field emission print head according to the embodiment of the present invention.

A fourth embodiment of the field emission print head according to the present invention will now be described with reference to FIGS. 14 to 16. FIG. 14 shows examples of gate lines and cathode lines when a cathode substrate 1 constituting the field emission print head according to this embodiment is viewed from an upper position. FIG. 15 is a partial cross sectional view of the field emission print head according to the present invention and taken along line 15—15 shown in FIG. 14. FIG. 16 is a perspective view of the field emission print head according to the present invention, in which the structures of the gate lines, the cathode lines and the anode lines are illustrated.

The field emission print head according to this embodiment of the present invention, as shown in FIG. 15, has a plurality of cathode lines C1, C2, C3, . . . , Cn (only three cathode lines C (n−2), C (n−1) and Cn are illustrated) formed on one surface of the cathode substrate 1. On the cathode lines C1, C2, C3, . . . , Cn, there are formed a plurality of cone-like emitters 3 for respectively forming field emission arrays. On the cathode substrate 1, there is formed an insulating layer 2 made of SiO2 and so forth. On the insulating layer 2, there are formed n gate lines GT11 to GT1n (only two gate lines GT1 (n−1) and GT1n are illustrated), and converging electrodes GT31 to GT3 (n+1) (only the converging electrodes GT31 to GT35 are illustrated) between the gate lines GT11 to GT1n and on the outside of the gate lines GT11 and GT1n.

To cause the converging electrodes GT31 to GT3 (n+1) to converge emitted electrons, the potential of the converging electrodes GT31 to GT3 (n+1) is made to be a low level (or zero level or a negative level) by making the potential of the second gate lead electrode GT2 to be always a low level (or zero level or a negative level).

The cathode lines C1 to Cn, the gate lines GT11 to GT1n and the emitters 3 constitute the field emission arrays FE1 to FEn. The field emission arrays FE1, FE3, . . . , FE (n−1) are formed into an elongated stripe configuration, as shown in FIG. 3.

The width of the electrode of each of the gate lines GT11 to GT1n is made to be wider than the width of the electrode of each of the cathode lines C1 to Cn as shown in FIG. 14. The width of each of the converging electrodes GT31 to GT3n is smaller than that of the electrode of each of the gate lines GT11 to GT1n.

The anode substrate 10 is disposed opposite to the cathode substrate 1 while being apart from the same for a predetermined distance. The anode electrode formed on the cathode substrate 1 is composed of the anode line A11 disposed substantially perpendicular to the gate lines GT11 to GT1n and having the stripe slit 14; and two anode converging electrodes A32 disposed on the two sides of the anode line A11.

The anode line A11 has the slit 14 for taking out light emitted by the fluorescent member 12. The stripe fluorescent member 12 is applied to cover the slit 14. Note that the anode line A11 and the anode converging electrode A32 are made of thin films made of metal, such as aluminum.

The fluorescent member 12 emits light when electrons emitted from the field emission arrays FE1 to FEn collide with the fluorescent member 12. Since the field emission arrays FE1 to FEn are formed into the stripe shape in a direction substantially perpendicular to the anode line A11, the permissible range for positioning the anode substrate 10 with respect to the cathode substrate 1 can be widened when the cathode substrate 1 and the anode substrate 10 are bonded to each other to manufacture the field emission print head.

By forming the slit 14 in the anode line A11 made of a thin metal film, a precise light emission pattern can be obtained even if the structure is in the form of a thin film. Therefore, the permissible range for patterning the fluorescent member 12 can be widened.

Therefore, the field emission print head according to the present invention can easily be manufactured.

The width of the slit 14 is about 85 $\mu$m when the resolution is 300 dpi, about 42 $\mu$m when the resolution is 600 dpi and about 21 $\mu$m when the resolution is 1200 dpi.

The cathode substrate 1, the anode substrate 10 and side plates (not shown) constitute a vacuum and airtight container, the inside portion of which is high vacuum. Since light emitted by the fluorescent member 13 is taken out through the anode substrate 10, the anode substrate 10 is made of glass. Note that also the cathode substrate 1 may be made of glass.

The anode line A11 and the anode converging electrode A32 are, as described above, made of thin films made of metal, such as aluminum. To prevent reflection due to a thin film made of metal, such as aluminum, which has a large reflectance, a titanium oxide film may be formed in the interface between the anode substrate 10 and the thin aluminum film to be formed into a reflection preventive film. As a result, light exhibiting high contrast can be obtained.

Figure 17:
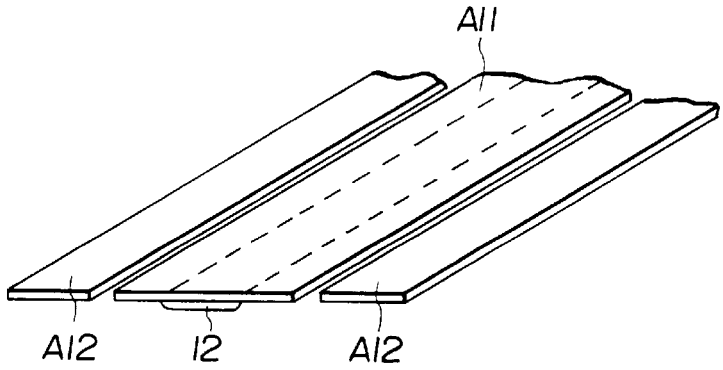
FIG. 17 is a diagram showing a modification of the embodiment of the field emission print head according to the present invention.

The anode line A11 and the anode converging electrode A32 may be made of transparent and conductive materials, such as ITO. The structure of the anode electrode in this case is shown in FIG. 17. Since the anode line A11 is transparent, the necessity of forming the slit 14 to take out light emitted from the fluorescent member 12 can be eliminated. Therefore, the stripe fluorescent member 12 is formed below the anode line A11, as shown in FIG. 17.

A method of operating the field emission print head having the foregoing structure and according to the fourth embodiment will now be described.

As described above, the n gate lines GT11 to GTn are connected to the first gate lead electrode GT1, while the (n+1) converging electrodes GT31 to GT3 (n+1) are connected to the second gate lead electrode GT2. The first gate lead electrode GT1 is supplied with positive gate operation voltage when the field emission print head is operated. Thus, electrons corresponding to image data for one line supplied to the cathode lines C1 to Cn are emitted from the field emission cathodes FE1 to FEn of the first gate lead electrode GT1.

At this time, the potential of the second gate lead electrode GT2 is made to be always a low level (or zero level or a negative level).

When, for example, the first gate lead electrode GT1 has been operated, the potential of the converging electrode GT33 and the converging electrode GT34 disposed on the two sides of, for example, the gate line GT13, is made to be a low level. In the foregoing case, the influence of the electric fields of the low level converging electrodes GT33 and GT34 disposed on the two sides of the gate line GT13 prevents dispersion of electrons emitted from the gate line GT13. Thus, electrons can be converged.

As a result, electrons field-emitted due to the operation of the first gate lead electrode GT1 are converged due to the operations of the converging electrodes GT21 to GT2 (n+1), the level of which is made to be always low level (or zero level or a negative level) and directed to the anode line A11.

Since no gate line exists on the outside of the gate line GT11 and the gate line G1n, the converging electrodes GT31 and GT3 (n+1) are disposed to converge electrons.

In the anode portion, the anode line A11 is always supplied with positive operating voltage and the anode converging electrode A32 is always supplied with a low level potential (or zero level or a negative level).

Since the anode line A11 is disposed between the low level anode converging electrode A32, the effect of the electric field causes electrons emitted from the gate lines GT11 to GT1n to be further converged and then allowed to reach the anode line A11. The direction in which electrons are converged is, in this case, a direction perpendicular to the anode line A11. The effect of the converging electrodes GT31 to GT3 (n+1) causes electrons to be converged into a direction which is in parallel to the anode line A11. Thus, electrons emitted from the operated field emission arrays FE1 to FEn are effectively converged to have a circular converging cross section.

Thus, an image for one line is recorded on a recording medium. Then, the line sequential scanning is performed similarly so that an image for one image screen is recorded on the recording medium.

Figure 18:
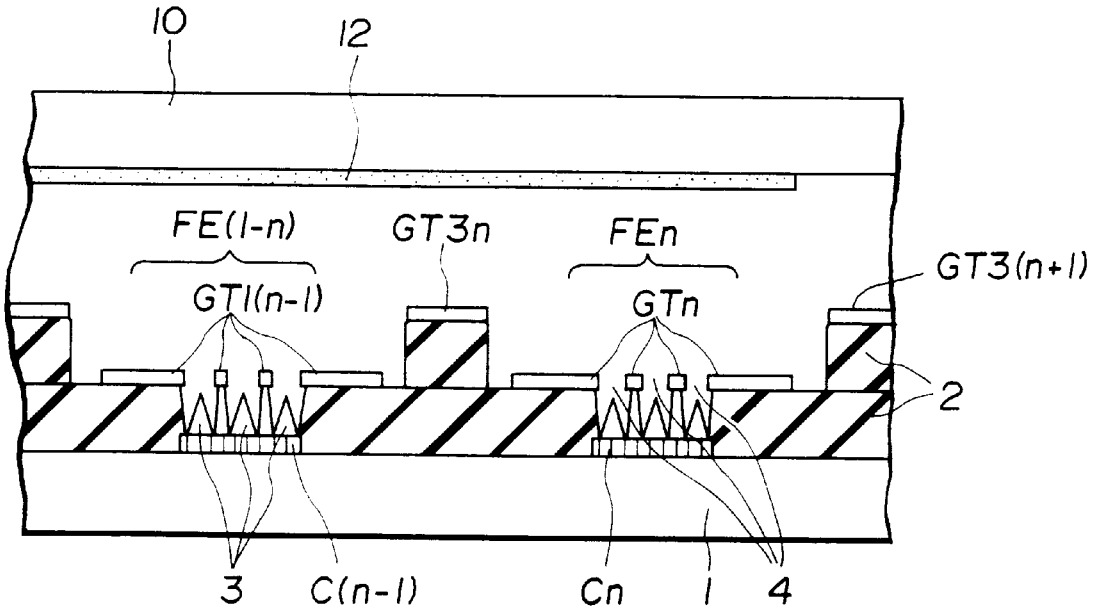
FIG. 18 is a partial side cross sectional view showing the structure of the embodiment of the field emission print head according to the present invention.

A modification of the field emission print head according to this embodiment will now be described with reference to FIG. 18. FIG. 18 is a partial cross sectional view of the modification of the field emission print head. The same reference numerals as those shown in FIG. 15 represent the same elements.

The modification has a structure such that the converging electrodes GT31 to GT3 (n+1) are formed at other positions. As shown in FIG. 18, another insulating layer 2 is formed on the insulating layer 2 on which the gate lines GT11 to GT1n are formed. On the insulating layer 2, the converging electrodes GT31 to GT3 (n+1) are formed. As a result, the converging electrodes GT31 to GT3 (n+1) are made to approach the anode line A11 than the gate lines GT11 to GT1n so that the degree of conversion of electrons is further raised.

Since the other structures and operations are the same as those of the foregoing embodiment, they are omitted from description.

In the field emission print head according to the present invention, the line pitch of the cathode lines C1 to Cn corresponding to the pixel pitch is about 85 $\mu$m when the resolution is 300 dpi, about 42 $\mu$m when the resolution is 600 dpi and about 21 $\mu$m when the resolution is 1200 dpi. The cathode lines C1 to Cn may be drawn from the two sides of the cathode substrate. In this case, the line pitch is twice the line pitch in the foregoing case.

As described above, the present invention has the structure such that the potential of non-selected gate lines is made to be a low potential (or zero level or a negative level) when the odd order gate lines and the even order gate lines are alternately selected and operated. Therefore, the selected and operated gate line is disposed between low potential gate lines so that electrons emitted from the selected and operated gate line are converged.

Moreover, since the selected and operated anode line in the anode portion is disposed between the low potential non-selected anode line and the dummy anode, also the anode portion is enabled to converge electrons. When the directions in which electrons are converged in the gate portion and the anode portion are made to be perpendicular to each other, electrons can efficiently be converged.

Therefore, leakage light emission from the adjacent pixels can be prevented while maintaining the resolution and preventing brightness from being lowered by lowering the anode potential.

Since the field emission arrays formed on the odd order gate lines and the even order gate lines are disposed in the zigzag configuration, the apparent pixel interval between adjacent pixels can be enlarged so that the resolution is raised. For example, an excellent resolution of 600 dpi or higher can be achieved.

When the odd order gate lines and the even order gate lines are alternately selected and operated, the potential of non-selected gate lines is made to be a low potential (or zero level or a negative level). Therefore, the selected and operated gate line is disposed between low potential gate lines so that electrons emitted from the selected and operated gate line are converged.

Moreover, since the selected and operated anode line in the anode portion is disposed between the low potential dummy anodes, also the anode portion is enabled to converge electrons. Since the directions in which electrons are converged in the gate portion and the anode portion are made to be perpendicular to each other, electrons can efficiently be converged.

Since the field emission array formed in the cathode portion has an elongated stripe shape, the permissible range for positioning the anode substrate with respect to the cathode substrate can be widened when the cathode substrate and the anode substrate are bonded to each other. As a result, the field emission print head can easily be manufactured.

Moreover, the potential of the converging electrodes disposed between gate lines and on the outside of the two terminative ends of the gate line is made to be a low potential when the gate line is operated. Therefore, the operated gate line is disposed between low potential converging electrodes so that field-emitted electrons are converged.

Since the selected and operated anode line in the anode portion is disposed between the low potential anode converging electrodes, also the anode portion is enabled to converge electrons.

Since the converging electrode is formed more adjacent to the anode line than the gate line, emitted electrons can be converged more efficiently.

As a result, leakage light emission from adjacent pixels can be prevented while maintaining the resolution and without a means for lowering the anode potential to lower the brightness.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A field emission print head, comprising:

a plurality of cathode lines formed on a cathode substrate;

field emission cathode arrays formed on said cathode lines;

a plurality of gate lines formed on said cathode substrate through an insulating layer at positions opposite to said field emission cathode arrays;

a first gate lead electrode connected to odd order gate lines of said plurality of gate lines;

a second gate lead electrode connected to even order gate lines of said plurality of gate lines;

wherein said even and said odd order gate lines are patterned to be interdigitated with each other and when operated the even and odd order gate lines are alternately selected, and non-selected gate lines receive a lower potential than selected gate lines thereby to accelerate electrons emitted from the selected gate lines to be converged by the potential of the non-selected gate lines; and an anode substrate including a plurality of phosphor coated anode lines disposed opposite to said cathode substrate at positions opposite to said field emission cathode arrays.

2. A field emission print head according to claim 1 wherein said anode substrate is disposed opposite to said cathode substrate, said field emission cathode arrays comprise a first line of said field emission cathode arrays formed opposite said odd order gate lines and a second line of said field emission cathode arrays formed opposite said even order gate lines, the field emission cathode arrays of said first line are disposed in a zigzag configuration while being apart for a predetermined distance from the field emission cathode arrays of the second line, and a potential of a non-selected gate lead electrode among said first gate lead electrode and said second gate lead electrode, which are alternately selected and operated, is made to be a low level.

3. A field emission print head according to claim 2 comprising:

said anode lines formed opposite to said gate lines and in parallel to said gate lines, a first anode lead electrode to which odd order anode lines among said anode lines are connected, a second anode lead electrode to which even order anode lines among said anode lines are connected, fluorescent members in a first line covering said odd order anode lines, and fluorescent members in a second line covering said even order anode lines, said fluorescent members in said first line of fluorescent members and said fluorescent members in said second line of fluorescent members disposed in a zigzag configuration while being apart from each other to correspond to said field emission arrays in said first line of field emission arrays and said field emission arrays in said second line of field emission arrays, and a potential of a non-selected anode lead electrode among said first anode lead electrode and said second anode lead electrode, which are alternately selected and operated, is made to be a low level.

4. A field emission print head according to claim 2, comprising:

said anode lines comprise first and second anode lines formed opposite and substantially perpendicular to said gate lines and two dummy anode lines disposed on opposite sides of said first and second anode lines, a first line of fluorescent members formed on said first anode line to correspond to said field emission arrays in said first line of field emission arrays, a second line of fluorescent members formed on the second anode line to correspond to said field emission arrays in said second line of field emission arrays, and a potential of a non-selected anode line of said first and second anode lines, which are alternatively selected and operated, and either of said two dummy anode lines, is made to be a low level.

5. A field emission print head according to claim 1, comprising:

said anode lines comprising first and second anode lines formed opposite and substantially perpendicular to said gate lines and two dummy anode lines disposed on opposite sides of said first and second anode lines, fluorescent members in a first line formed on said first anode line to correspond to field emission arrays in a first line of field emission arrays, and fluorescent members in a second line formed on the second anode line to correspond to field emission arrays in said second line of field emission arrays, and a potential of a non-selected anode line of said first and second anode lines, which are alternately selected and operated, and either of said two dummy anode lines, between which said first and second anode lines are interposed, is made to be a low level.

6. A field emission print head according to claim 1, wherein:

said anode lines comprise at least one anode line formed opposite and substantially perpendicular to said gate lines and two dummy anode lines disposed on opposed sides of said at least one anode line, said at least one anode line has a stripe fluorescent member formed in an axial direction thereof, a potential of a non-selected gate lead electrode of said first gate lead electrode and said second gate lead electrode, which are alternately selected and operated, is made to be a low level, and a potential of said two dummy anode lines is made to be a low level.

7. A field emission print head according to claim 6, wherein said at least one anode line is made of a thin metal film having a slit formed in the axial direction thereof and said slit is coated with said fluorescent member to cover said slit.

8. A field emission print head according to claim 1, further comprising:

a plurality of converging electrodes disposed between said gate lines and on the outside of two terminative ends of said gate lines; wherein said anode lines comprise at least one anode line formed opposite to said gate line in a direction substantially perpendicular to said gate line and two anode converging electrodes disposed on the opposed sides of said at least one anode line, said at least one anode line has a strip fluorescent member formed in an axial direction thereof, a potential of said second gate lead electrode is made to always be a low level, and a potential of said two anode converging electrodes is made to always be a low level.

9. A field emission print head according to claim 8, wherein said at least one anode line is made of a thin metal film, said at least one anode line having a slit formed in the axial direction thereof and coated with said fluorescent member to cover said slit.

10. A field emission print head according to claim 8 or 9, wherein said converging electrodes are disposed adjacent to said anode substrate separated from said gate lines in a direction from said cathode lines to said anode substrate.

* * * * *